US010808418B2

(12) United States Patent
Thiem

(10) Patent No.: US 10,808,418 B2
(45) Date of Patent: Oct. 20, 2020

(54) FENCING CONNECTOR

(71) Applicant: Wayne R. Thiem, Bozeman, MT (US)

(72) Inventor: Wayne R. Thiem, Bozeman, MT (US)

( * ) Notice: Subject to any disclaimer, the term of this patent is extended or adjusted under 35 U.S.C. 154(b) by 395 days.

(21) Appl. No.: 15/895,408

(22) Filed: Feb. 13, 2018

(65) Prior Publication Data

US 2018/0238076 A1 Aug. 23, 2018

Related U.S. Application Data

(60) Provisional application No. 62/460,391, filed on Feb. 17, 2017.

(51) Int. Cl.
*E04H 17/14* (2006.01)

(52) U.S. Cl.
CPC . *E04H 17/1421* (2013.01); *E04H 2017/1473* (2013.01)

(58) Field of Classification Search
CPC ..... E04H 17/1421; E04H 2017/1447; E04H 2017/1473; F16B 7/044; F16B 7/0446; F16B 7/22; Y10T 403/4614
USPC ..... 256/65.02, 65.04, 65.07, 65.08; 403/235
See application file for complete search history.

(56) References Cited

U.S. PATENT DOCUMENTS 249,066 A * 11/1881 Martin ..... A01B 35/225 403/188
415,382 A * 11/1889 Darnell ..... E04F 11/181 256/65.08
415,383 A * 11/1889 Darnell ..... E04F 11/181 256/65.08
3,021,159 A * 2/1962 Back ..... F16B 7/0446 403/191
4,195,385 A * 4/1980 Cole ..... E05D 5/10 16/382
4,526,348 A 7/1985 Cammack
(Continued)

FOREIGN PATENT DOCUMENTS

DE 202010000002 U1 * 5/2011 ..... E04H 17/18
FR 2449768 A1 * 9/1980 ..... E04H 17/1413
FR 2896282 A1 * 7/2007 ..... E04H 17/1421

OTHER PUBLICATIONS

"Bearing Retainer Spanner Wrench." Amazon. [online], [retrieved on Jun. 8, 2020]. Retrieved from the Internet <URL: https://www.amazon.com/Jinyi-Bearing-Retainer-Mercruiser-Blackhawk/dp/B07VT2Z7QH>.*

(Continued)

*Primary Examiner* — Josh Skroupa
(74) *Attorney, Agent, or Firm* — Sheridan Ross P.C.

(57) ABSTRACT

A fencing connector, H brace assembly incorporating a fencing connector, and method of constructing an H brace using a fencing connector, where the fencing connector includes a tongue portion, and a ring portion in which an aperture is formed. The tongue and ring portions lie in a common plane. The fencing connector can be formed from a single piece of material. The ring portion of the fencing connector is configured to fit over a vertical fence post, and the tongue portion of the fencing connector is configured to fit inside of a horizontal member that extends between the first vertical post and a second vertical post. In an H brace assembly, a fencing connector is provided at each end of the horizontal member. In addition, in such an assembly, stops may be fixed to the vertical posts to maintain the fencing connectors at a desired location along the respective vertical posts.

23 Claims, 4 Drawing Sheets

(56) References Cited

U.S. PATENT DOCUMENTS

| | | | | |
|---|---|---|---|---|
| 4,679,772 | A * | 7/1987 | Peterson | E04H 17/08 256/35 |
| 4,923,176 | A | 5/1990 | Heinz | |
| 5,362,030 | A * | 11/1994 | Iler, Jr. | E04H 17/1413 256/65.08 |
| 5,452,880 | A | 9/1995 | Bailey | |
| 5,961,242 | A | 10/1999 | Leone | |
| 6,176,042 | B1 * | 1/2001 | Rossman | A01K 1/0017 160/210 |
| 6,406,003 | B1 | 6/2002 | Shaw | |
| 6,779,782 | B1 | 8/2004 | Webb | |
| 7,062,836 | B1 | 6/2006 | Sorgi | |
| 7,121,530 | B1 | 10/2006 | Preta | |
| 7,883,288 | B2 * | 2/2011 | Jorna | F16B 7/0453 403/171 |
| 9,151,074 | B2 | 10/2015 | Walters | |
| 9,366,055 | B1 * | 6/2016 | Wright | E04H 17/00 |
| 2009/0032792 | A1 | 2/2009 | Ford et al. | |
| 2010/0072749 | A1 | 3/2010 | Voelkel | |
| 2013/0098910 | A1 | 4/2013 | Simpson | |
| 2014/0131647 | A1 | 5/2014 | Dillon | |
| 2014/0199112 | A1 | 7/2014 | Milner et al. | |
| 2015/0117936 | A1 | 4/2015 | Hart et al. | |
| 2019/0040650 | A1 * | 2/2019 | Durham | E04H 17/1421 |

OTHER PUBLICATIONS

"Blanking." Unipunch. [online], [retrieved on Jun. 8, 2020]. Retrieved from the Internet <URL: https://www.unipunch.com/system-capabilities/typical-work-done/blanking>.*

"Custom Flat Wrenches." Metalnerd. [online], [retrieved on Jun. 8, 2020]. Retrieved from the Internet <URL: http://www.metalnerd.com/flat-wrenches>.*

"Google Pixel: Insert/Eject Sim Card." Technipages. [online], [retrieved on Jun. 8, 2020]. Retrieved from the Internet <URL: https://www.technipages.com/google-pixel-insert-eject-sim-card>.*

"Opener." imall. [online], [retrieved on Jun. 8, 2020]. <URL: https://imall.com/product/20Pcs-Iot-Metal-Universal-Sim-Card-Tray-Pin-Ejecting-Removal-Needle-Opener-Ejector-For-Mobile-phone/Cellphones-Telecommunications-Parts-Repair-Tools-Tool-Sets/aliexpress.com/33004611659/568-7374478/en>.*

"Stainless Steel Bottle Opener." Myron. [online], [retrieved on Jun. 8, 2020]. Retrieved from the Internet <URL: https://www.myron.com/Under-%2499/Stainless-Steel-Bottle-Opener/p/OPENBOTTLEOPENER>.*

"Sterling Bubble Blower." Sterling Collectables. [online], [retrieved on Jun. 8, 2020]. Retrieved from the Internet <URL: https://www.sterlingcollectables.com/sterling-collectables-sterling-bubble-blower>.*

"New UK Manufactured Metal Strainer Systems, Box Strainer Systems & Angle Strainer Systems," Hampton Steel, Sep. 2017, Product Page, 4 pages [retrieved online from: www.hamptonsteel.co.uk/media/com_products/product_page_pdf/1506338855-82_hampton_strainer_leaflet-sept%202017-compressed.pdf].

* cited by examiner

FENCING CONNECTOR

CROSS-REFERENCE TO RELATED APPLICATIONS

This application claims the benefit of U.S. Provisional Patent Application Ser. No. 62/460,391, filed Feb. 17, 2017, the entire disclosure of which is hereby incorporated herein by reference.

FIELD

The present disclosure provides a connector for joining components of a fence. More particularly, embodiments of the present disclosure provide a connector, also referred to herein as a fencing or key hole connector, that can be used to create an "H" brace for a fence.

BACKGROUND

Fences often feature H braces to provide strength in a direction parallel to the fence line. For example, fences incorporating tensioned wires can require an H brace at corners in the fence line, or periodically along the fence line, in order to provide an adequately sturdy and long-lasting fence structure. Multiple H braces can also be used in combination with one another. For example, at each corner in the fence line, two H braces can be constructed that share a corner post where the fence lines extending from each of the H braces intersect.

An H brace generally includes a horizontal member that is joined to and that extends between two vertical fence posts. The H brace can also include a diagonal member, such as a tensioned wire or cable. In general, the diagonal member extends from a location near the ground of the first vertical post, in the direction of the tension that is or will be applied by the tensioned fencing wires, to a location distal from ground and at or near the intersection of the horizontal member and the second vertical post, thereby transferring tension from the top of the second post to the base of the first post. Where desired, for example in a middle portion of a fence line, two crossed diagonal members can be included in the H brace, to provide stability in both directions along the fence line.

In constructing an H brace, the horizontal member is typically joined to the vertical posts by various components, such as pins, brackets or hangers, which can require careful alignment and sizing of the components. In addition, because the components typically need to be joined to the vertical posts and horizontal member using fasteners and/or specially prepared holes, the process of building an H brace has been relatively time consuming and is prone to errors in alignment that can lead to structural weaknesses. The components of an H brace can also be joined to one another by welding. However, welding requires careful alignment and sizing, and a skilled operator, in order to form a satisfactory joint. In addition, because of fire safety concerns, the use of welding to construct fences can be banned during dry or drought conditions.

SUMMARY

Disclosed herein is a connector for joining the components of a fence. More particularly, embodiments of the present disclosure provide a connector, also referred to herein as a fencing or key hole connector, that can be used in constructing an "H" brace for a fence that includes a horizontal member and a tensioning element that extend between two vertical fence posts. The connector facilitates the fast and secure assembly of an H brace, without requiring precise alignment of the components.

The fencing connector is used to help secure the ends of the horizontal member to the posts. In accordance with embodiments of the present disclosure, the fencing connector is a planar element formed from a single or integral piece of material that includes a head or ring portion in which an aperture is formed, and a tab or tongue portion that extends from the head portion. The aperture is configured to fit around the exterior of a vertical post, while the tab is configured to fit within an interior of the horizontal member. A stop or support member is used to locate the connector along the length of the vertical post at a desired height. One or more additional stops can be provided to provide an anchor location for one or more stays. The stops can, for example, comprise a conventional brace band or band strap.

In accordance with an exemplary embodiment of the present disclosure, an H brace is constructed by placing two adjacent vertical fence posts in the ground. For example, fence posts formed of tubular steel or any type of pipe may be driven into the ground at a desired distance from one another, along the fence line. Next, stops are placed on the posts. One stop may be placed on one or both posts that is secured near the ground. This stop can form an attachment location for a stay. A stop is then placed on both posts at a selected distance from the ground to maintain the fencing connector, and therefore the horizontal member, at the desired height. Next, a fencing connector is placed over each of the posts. Specifically, the aperture of the fencing connector is placed over the post, and the fencing connector is allowed to rest on the stop. The tab of each fencing connector is then placed inside the horizontal member. For example, where the horizontal member is formed from tubular steel or any type of pipe, the tab of the fencing connector is received by the interior of the horizontal member. In accordance with embodiments of the present disclosure, the tolerances associated with the fencing connector are relatively loose, allowing play between the fencing connector and the components, and facilitating the fast assembly of the H brace. In addition, embodiments of the present disclosure can accommodate variations between the length of the horizontal member and the distance between the posts, the height of the stops used to support the fencing connectors, the alignment of the posts, or the like.

Additional features and advantages of embodiments of the present disclosure will become more readily apparent from the following description, particularly when understood in view of the accompanying drawings.

DETAILED DESCRIPTION

Figure 1:
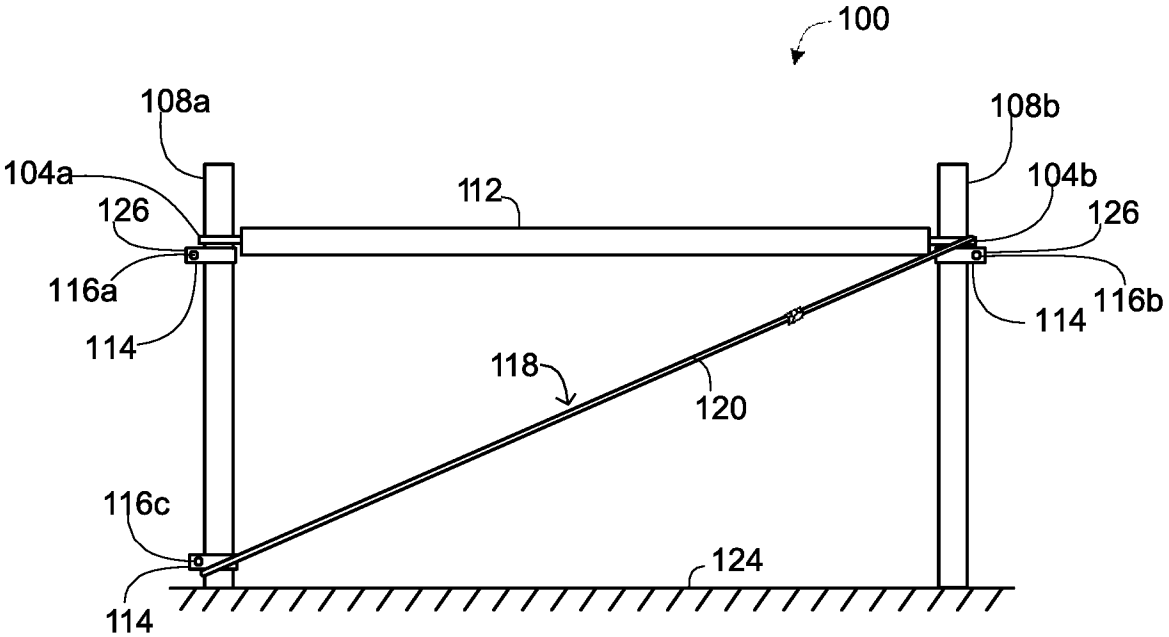
FIG. 1 depicts an H brace constructed using a fencing connector in accordance with embodiments of the present disclosure.

With reference to FIG. 1, an H brace 100 constructed using a fencing connector 104 in accordance with embodiments of the present disclosure, also referred to herein as a keyhole connector, is depicted. The H brace 100 includes first 108*a* and second 108*b* vertical posts. A horizontal member 112 extends between the vertical posts 108. First 104*a* and second 104*b* fencing connectors form an interface or interconnection between the horizontal member 112 and the vertical posts 108. The fencing connectors 104 each include a tongue portion 204 (see FIGS. 2-6) that extends into the hollow ends of the horizontal member 112, and a ring portion 212 that fits around a respective vertical post 108. The locations of the fencing connectors 104 along the respective vertical posts 108 is determined by first and second stops 114, in this example in the form of band clamps 116*a* and 116*b*. A tensioning member 118, in this example in the form of a cable stay 120, extends between a first end attached at or proximate to a third stop 114, in this example an additional band clamp 116*c*, on the first vertical post 108*a*, and a second end attached at or proximate to the fencing connector 104*b* adjacent a second end of the horizontal member 112 and the second band clamp 116*b* on the second vertical post 108*b*. The band clamp 116*c* is closer to the ground 124 than the band clamp 116*b*, such that the tensioning member 118 extends in a diagonal direction from near the base of the first vertical post 108*a* to an upper portion of the second vertical post 108*b*.

The configuration illustrated in FIG. 1 provides bracing against forces, such as may be applied by fencing wire, extending in a direction from the second vertical post 108*b*, towards the right in the figure. As can be appreciated by one of skill in the art after consideration of the present disclosure, other configurations are possible. For example, the tensioning member 118 can be configured such that it extends from a stop 114 positioned near the ground 124 on the second vertical post 108*b* to the fencing connector 104*a* adjacent the first end of the horizontal member 112 and the first band clamp 116*a* on the first vertical post 108*a* to provide bracing against forces extending from the first vertical post 108*a* towards the left in the figure. As yet another example, a first tensioning member 118 can extend from a stop 114 near the ground on the first vertical post 108*a* to the fencing connector 104*b* adjacent the second end of the horizontal member 112 and the second band clamp 116*b* on the second vertical post 108*b*, and a second tensioning member 118 can extend from a stop 114 near the ground 124 on the second vertical post 108*b* to the fencing connector 104*a* adjacent the first end of the horizontal member 112 and the first band clamp 116*a* on the first vertical post 108*a*, to provide bracing against forces applied away from the H brace 100 in both the left and the right directions in the figure. In addition, the tensioning member 118 can pull the vertical posts 108 towards one another, placing a compressive load on the fencing connectors 104 and the horizontal member 112, thereby creating a relatively rigid H brace structure 100, even using fencing connectors 104 that are loosely fitted around the vertical posts 108 and/or loosely fitted inside the horizontal member 112.

Figure 2:
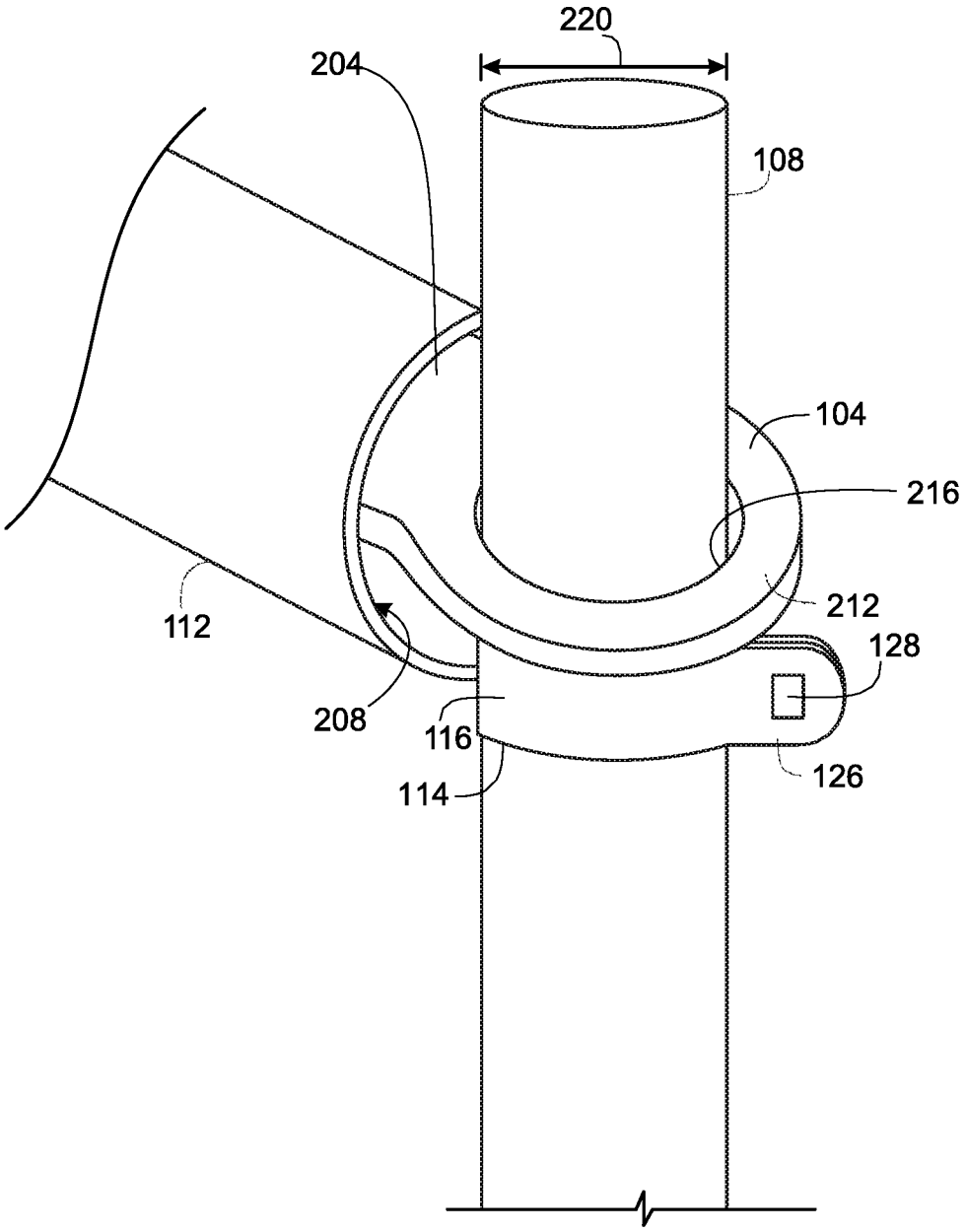
FIG. 2 depicts an interface between a vertical fence post, a fencing connector in accordance with embodiments of the present disclosure, and a horizontal member.
Figure 3:
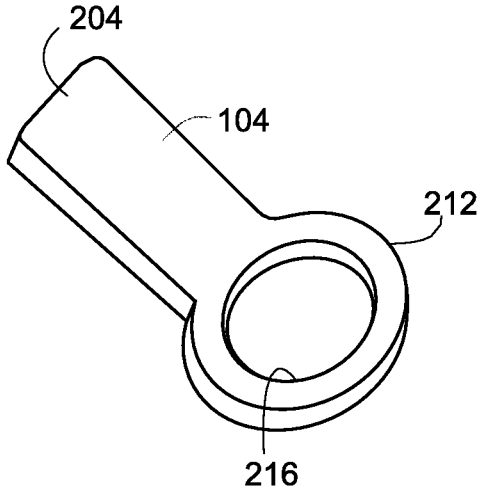
FIG. 3 is a perspective view of a fencing connector in accordance with embodiments of the present disclosure.
Figure 4:
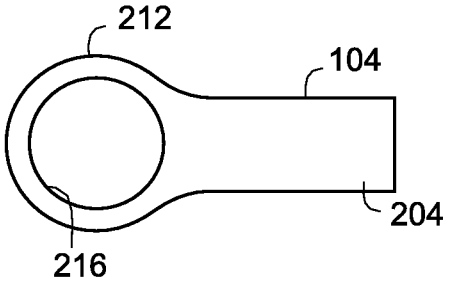
FIG. 4 is a top plan view of a fencing connector in accordance with embodiments of the present disclosure.
Figure 5:
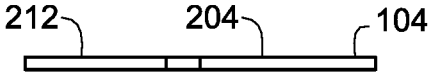
FIG. 5 is a right side view in elevation of a fencing connector in accordance with embodiments of the present disclosure.
Figure 6:
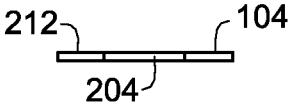
FIG. 6 is a front end view in elevation of a fencing connector in accordance with embodiments of the present disclosure.

FIG. 2 depicts an interface between a vertical fence post 108, a fencing connector 104, and a horizontal member 112, and FIGS. 3-6 are views of a fencing connector 104 in accordance with embodiments of the present disclosure. As shown, the fencing connector 104 includes a tongue portion 204 that extends into a hollow interior diameter or cavity 208 of the horizontal member 112. In addition, the fencing connector 104 includes a ring portion 212 with an aperture 216 that fits around an exterior diameter 220 of the vertical post 108. The tongue portion 204 and the ring portion 212 lie in a common plane. In addition, as shown best in FIGS. 3-4, an outer diameter of the ring portion 212 can be greater than a width of the tongue portion 204, such that an end of the horizontal member 112 can bear against the ring portion 212, at least after the tensioning member 118 is in place and is tensioned.

In accordance with embodiments of the present disclosure, the tongue portion 204 and ring portion 212 of the fencing connector 104 are sized to have a relatively "loose" fit inside the interior diameter 208 of the horizontal member 112 and around the exterior diameter 220 of the vertical post 108 respectively. Moreover, a fencing connector 104 as disclosed herein can be sized for use with vertical posts 108 and a horizontal member 112 formed from any size of pipe or other material.

As examples, and without limitation, for a horizontal member 112 with an interior diameter 208 of about 2", the tongue portion 204 of the fencing connector 104 can have a width of about 1.75" and a length of about 4". For a vertical post 108 with an outside diameter of about 2", the aperture 216 of the ring portion 212 can have an inner diameter of about 2.5". The outer diameter of the ring portion 212 can be larger than the inner diameter of the horizontal member 112, for example 3". The fencing connector 104 can be formed from a single metal plate, for example galvanized steel, that is about 0.25" thick. The vertical posts 108 can be formed from galvanized metal pipe, round fence tubing, or any other type of pipe or tubing. Similarly, the horizontal member 112 can comprise galvanized metal pipe, round fence tubing, or any other type of pipe or tubing.

The first and second stops 114 of the H brace 100 are configured to prevent the fencing connectors 104 from sliding down the vertical posts 108. For example, the stops 114 can feature an external diameter that is larger than an interior diameter of the aperture 216, and/or can provide a surface against which an end of the tensioning element 118 can bear. As another example, for instance where the stop 114 is in the form of a band clamp 116, fixing tabs 126 (see FIG. 2), where the opposite ends of the band clamp 116 are brought together by a fastener 128 to fix the band clamp to the vertical post 108, can extend away from the post 108, creating a stop element. The third stop 114 is configured as an anchor to prevent the first end of the tensioning element 120 from sliding up the first vertical post 108*a*. In addition, the second stop 114 on the second vertical post 108*b* can be configured to prevent the second end of the tensioning element 120 from sliding down the vertical post 108*b*. In accordance with at least some embodiments of the present disclosure, the second end of the tensioning element 118 can be held in position by the second stop 114 alone, or by the second stop 114 in combination with the second fencing connector 104*b*. As can be appreciated by one of ordinary skill in the art after consideration of the present disclosure, the ends of a tensioning element 118 comprising a cable stay 120 can be in the form of loops that extend around the respective vertical post 108. In accordance with other embodiments of the present disclosure, the ends of the tensioning element 118 can be joined to brackets, for example provided as part of the stops 114, that are in turn joined to the respective vertical posts 108.

Figure 7:
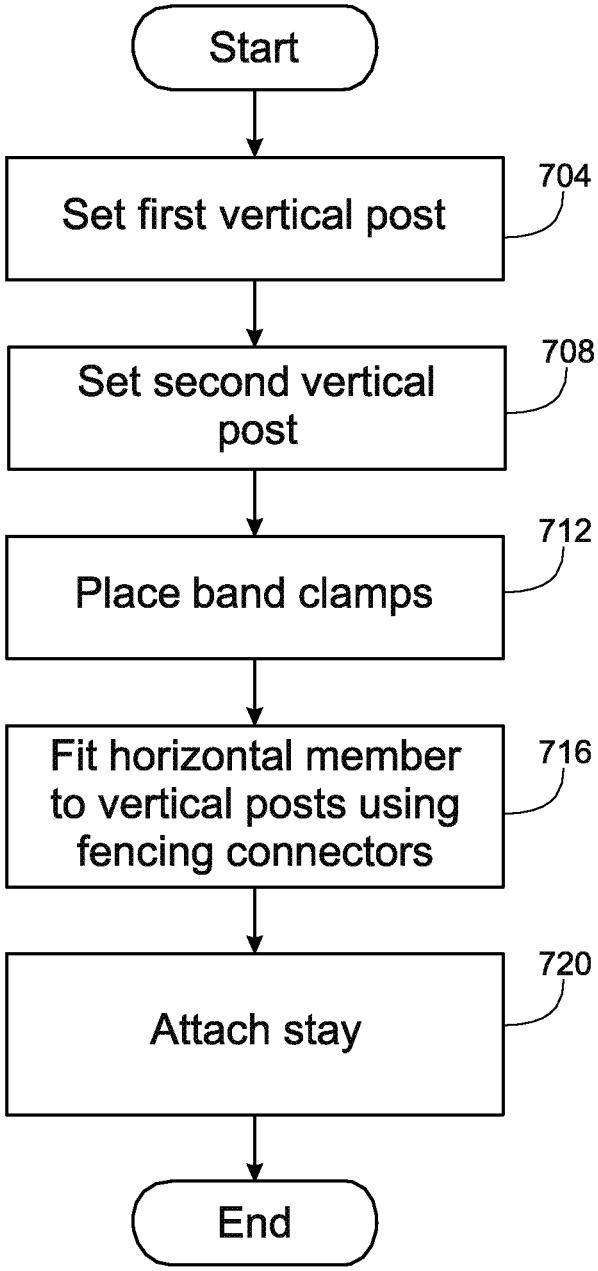
FIG. 7 is a flowchart illustrating steps of a process for constructing an H brace in accordance with embodiments of the present disclosure.

FIG. 7 is a flowchart depicting aspects of a method for constructing an H brace in accordance with embodiments of the present disclosure. Initially, a first vertical post 108*a* is set at a desired location along the intended fence line (step 704). The manner of setting the vertical post 108 can depend on the design parameters for the fence, the expected forces that will be placed on the fence, the characteristics of the ground 124, and the like. Next, a second vertical post 108*b* is set along the intended fence line (step 708). The vertical posts 108*a* and 108*b* are spaced apart from one another by a distance that is slightly greater than a length of the horizontal member 112.

At step 712, band clamps 116 are fixed to the vertical posts 108. The number of band clamps 116 on each vertical post 108 can depend on the desired configuration of the H brace. For example, the configuration shown in FIG. 1 is particularly suited to use with a barbed wire, electric, or other tensioned fence that extends to the right in the figure, and with the first vertical post 108*a* standing alone, in the middle of a fence line, or acting as a corner of a fence. In that configuration, there are two band clamps 116 on the first vertical post 108*a*, providing a band clamp 116*a* acting as a support for the fencing connector 104*a* and a corresponding end of the horizontal member 112, and a band clamp 116*c* acting as an anchor point for the first end of the cable stay 120. There is only a single band clamp 116*b* on the second vertical post 108*b*, which acts as a support for the fencing connector 104*b* and a corresponding end of the horizontal member 112, and as an anchor point for the second end of the cable stay 120. Alternatively, the H brace 100 could be constructed with two band clamps 116 on each vertical post 120, and two cable stays 120 in a crossed configuration. This second example is suited for use where the fence extends from both ends of the H brace 100, or where additional bracing is desired. Where two band clamps 116 are connected to a selected vertical post 108, one band clamp 116 is secured to the vertical post at a location proximate to the ground 124, and the other band clamp 116 is secured at the desired height of the horizontal member 112. Where one band clamp 116 is associated with a vertical post 108, that band clamp 116 is secured to the vertical post 108 at the desired height of the horizontal member 112.

Next, the horizontal member 112 is fitted to the vertical posts 108*a* and 108*b* using first 104*a* and second 104*b* fencing connectors (step 716). More particularly, the tongue 204 of the first fencing connector 104*a* is placed in an interior portion or cavity at a first end of the horizontal member 112, and the ring portion 212 of the first fencing connector 104*a* is placed around the first vertical post 108*a*. Next or at the same time, the tongue the hollow interior 204 of the second fencing connector 104*b* is placed in an interior portion or cavity at a second end of the horizontal member 112, and the ring portion 212 of the second fencing connector 104*b* is placed around the second vertical post 108*b*. Each fencing connector 104 is then allowed to rest against a respective band clamp 116*a* and 116*b*. Alternatively, the ring portion 212 of a fencing connector 104 can be placed over a vertical post 108 and the tongue portion of the fencing connector 104 can then be placed in an interior portion of the horizontal member 212.

At step 720, a tensioning member 118, for example in the form of a cable stay 120, is attached to a lower band clamp 116 at one end and to an upper band clamp 116 at another end, and is tensioned. For example, as shown in FIG. 1, a cable stay 120 can extend from a lower band clamp 116*c* near the base of the first vertical post 108*a* to an upper band clamp 116*b* on the second vertical post 108*b*. The H brace 100 is then complete. In accordance with further embodiments of the present disclosure, another tensioning member 118 can be provided that extends from a lower band clamp (not shown) on the second vertical post 108*b* to the upper band clamp 116*a* on the first vertical post 108*a*. Alternatively, a single tensioning member 118 can extend from a lower stop near a base of the second vertical post 108*b* to the stop 114 in an upper portion of the first vertical post 108*a*.

As discussed in connection with various exemplary embodiments of the present disclosure, the disclosed fencing connector 104 can be formed from an integral piece of material. As examples, but without limitation, the material forming a fencing connector 104 may be steel, galvanized steel, stainless steel, aluminum, plastic, a composite, or any other material. In addition, a fencing connector 104 as described herein can be used in connection with a variety of fencing materials. For example, a fencing connector can be used in connection with tubular vertical posts 108 and/or horizontal members 112. Such tubular vertical posts 108 and horizontal members 112 can be formed from a metal, plastic, or composite material. In addition, a fencing connector 104 in accordance with embodiments of the present disclosure can be used with vertical posts 108 formed from wood, and horizontal members 112 formed from wood that have been provided with a cavity at the ends thereof to receive the tongues 204 of respective fencing connectors 104. Moreover, the dimensions of a fencing connector 104 in accordance with embodiments of the present disclosure can be modified as required for use with vertical posts 108 and horizontal members 112 of different sizes and configurations. In addition, a fencing connector 104 in accordance with embodiments of the present disclosure can be used in connection with a variety of different stops 114, such as pins, threaded fasteners, bosses, or other protrusions formed or provided on a vertical post 108. In accordance with still other embodiments, a stop 114 may comprise a groove or slot formed in a vertical post 108 to receive a portion of a fencing connector 104 or a tensioning member 112. The tensioning member 112 is not limited to a cable stay 120, and can instead be any structure capable of applying tension between a top of one vertical post 108 and a base of another vertical post 108.

The foregoing discussion of the invention has been presented for purposes of illustration and description. Further, the description is not intended to limit the invention to the form disclosed herein. Consequently, variations and modifications commensurate with the above teachings, within the skill or knowledge of the relevant art, are within the scope of the present invention. The embodiments described hereinabove are further intended to explain the best mode presently known of practicing the invention and to enable others skilled in the art to utilize the invention in such or in other embodiments and with various modifications required by the particular application or use of the invention. It is intended that the appended claims be construed to include alternative embodiments to the extent permitted by the prior art.

What is claimed is:

1. An H brace assembly, comprising:

first and second vertical posts, wherein the first and second vertical posts are spaced apart from one another by a first distance;

a horizontal member; and first and second fencing connectors, wherein each fencing connector includes:

a tongue portion, wherein the tongue portion has a length and a width extending in a first plane; and a ring portion, wherein the ring portion has an aperture and lies in the first plane, wherein the tongue portion of the first fencing connector is received by a first hollow end of the horizontal member, wherein the width of the tongue portion of the first fencing connector is less than an interior dimension of the first hollow end of the horizontal member, wherein the aperture of the ring portion of the first fencing connector is placed over the first vertical post, wherein the tongue portion of the second fencing connector is received by a second hollow end of the horizontal member, wherein the width of the tongue portion of the second fencing connector is less than an interior dimension of the second hollow end of the horizontal member, wherein the aperture of the ring portion of the second fencing connector is placed over the second vertical post, and wherein the fencing connectors are each formed from an integral piece of material.

2. The assembly of claim 1, further comprising:

a first stop, wherein the first stop is fixed to the first vertical post and supports the first fencing connector; and a second stop, wherein the second stop is fixed to the second vertical post and supports the second fencing connector.

3. The assembly of claim 2, further comprising:

a third stop, wherein the third stop is fixed to the first vertical post, at a location below the first stop; and a tensioning member, wherein the tensioning member extends from the third stop to the second stop.

4. The assembly of claim 3, wherein the stops are band clamps.

5. The assembly of claim 3, wherein the tensioning member is a cable stay.

6. The assembly of claim 5, wherein the horizontal member is formed from a piece of metal fence tubing.

7. The assembly of claim 6, wherein the vertical posts are formed from metal fence tubing.

8. The assembly of claim 1, wherein, for each of the first and second fencing connectors, an outer diameter of the ring portion is greater than a width of the tongue portion.

9. The assembly of claim 8, wherein the outer diameter of the ring portion of the first fencing connector is greater than the interior dimension of the first hollow end of the horizontal member, and wherein the outer diameter of the ring portion of the second fencing connector is greater than the interior dimension of the second hollow end of the horizontal member.

10. The assembly of claim 1, wherein the integral piece of material is a flat metal plate.

11. The assembly of claim 1, wherein the aperture of the ring portion is a closed aperture.

12. A fencing assembly, comprising:

a vertical post;

a horizontal member; and a fencing connector, including:

a tongue portion; and a ring portion, wherein the fencing connector is formed from a flat plate, wherein a closed aperture is formed in the ring portion, wherein the tongue portion is sized to fit loosely within an interior diameter of the horizontal member, wherein the closed aperture formed in the ring portion is sized to fit loosely around an exterior diameter of the vertical post, and wherein an outer diameter of the ring portion is greater than a width of the tongue portion and greater than the interior diameter of the horizontal member.

13. The fencing assembly of claim 12, wherein the tongue portion and the ring portion of the fencing connector lie in a common plane.

14. The fencing assembly of claim 13, wherein the tongue portion and the ring portion of the fencing connector are formed from a single piece of material.

15. The fencing assembly of claim 14, wherein the single piece of material is a metal.

16. The fencing assembly of claim 15, wherein the metal is steel.

17. The fencing assembly of claim 12, wherein the closed aperture is circular.

18. A method of constructing an H brace, comprising:

placing a first vertical post along a fence line;

placing a second vertical post along the fence line;

placing a first fencing connector over the first vertical post, wherein the first fencing connector includes a ring portion having an aperture formed therein that fits over an outer diameter of the first vertical post, and wherein the first fencing connector includes a tongue portion;

placing a second fencing connector over the second vertical post, wherein the second fencing connector includes a ring portion having an aperture formed therein that fits over an outer diameter of the second vertical post, and wherein the second fencing connector includes a tongue portion;

placing the tongue portion of the first fencing connector inside an interior portion at a first end of a horizontal member, wherein a width of the tongue portion of the first fencing connector is formed to be less than a width of the interior portion at the first end of the horizontal member;

placing the tongue portion of the second fencing connector inside an interior portion at a second end of the horizontal member, wherein a width of the tongue portion of the second fencing connector is formed to be less than a width of the interior portion at the second end of the horizontal member;

fixing a first end of a tensioning member to the first vertical post, proximate to a base of the first vertical post; and fixing a second end of the tensioning member to the second vertical post proximate to the second fencing connector.

19. The method of claim 18, further comprising:

prior to placing the first fencing connector over the first vertical post, fixing a first stop to the first vertical post, wherein, at least prior to placing the tongue portion of the first fencing connector inside the interior portion at the first end of the horizontal member, the first fencing connector is supported by the first stop.

20. The method of claim 19, further comprising:

prior to placing the second fencing connector over the second vertical post, fixing a second stop to the second vertical post, wherein, at least prior to placing the tongue portion of the second fencing connector inside the interior portion at the second end of the horizontal member, the second fencing connector is supported by the second stop.

21. The method of claim 20, further comprising:

prior to fixing the first stop to the first vertical post, fixing a third stop to the first vertical post, wherein fixing the first end of the tensioning member to the first vertical post includes placing at least a portion of the first end of the tensioning member in contact with the third stop.

22. The method of claim 21, wherein fixing the second end of the tensioning member to the second vertical post proximate to the second fencing connector includes placing a portion of the second end of the tensioning member over a portion of the second fencing connector.

23. The method of claim 18, wherein placing the first and second vertical posts along the fence line includes pounding the first and second fence posts into the ground.

* * * * *